US007017322B1

(12) United States Patent
Annehed et al.

(10) Patent No.: US 7,017,322 B1
(45) Date of Patent: Mar. 28, 2006

(54) CLOSURE FEED SYSTEM WITH A SPOUT DIVERTER/SINGULATOR

(75) Inventors: Stefan Annehed, Ham Lake, MN (US); Hisami Mitsuishi, Blaine, MN (US); Petr Sevcik, Cambridge, MN (US); Martin Fuzik, Eden Prairie, MN (US)

(73) Assignee: Tetra Laval Holdings & Finance, SA, Pully (CH)

( * ) Notice: Subject to any disclaimer, the term of this patent is extended or adjusted under 35 U.S.C. 154(b) by 0 days.

(21) Appl. No.: 10/968,084

(22) Filed: Oct. 19, 2004

(51) Int. Cl.
*B65B 61/00* (2006.01)
*B65B 3/02* (2006.01)

(52) U.S. Cl. ..... 53/133.2; 53/168; 53/282; 493/87

(58) Field of Classification Search ..... 53/133.2, 53/168
See application file for complete search history.

(56) References Cited

U.S. PATENT DOCUMENTS

| | | | | |
|---|---|---|---|---|
| 1,086,827 A | | 2/1914 | Klett | |
| 2,006,450 A | * | 7/1935 | Gaynor | 53/301 |
| 2,186,841 A | | 6/1940 | Rylander | |
| 2,246,431 A | | 6/1941 | Cochran | |
| 3,513,623 A | * | 5/1970 | Pearson | 53/497 |
| 4,250,685 A | | 2/1981 | Elsworth | |
| 4,705,152 A | | 11/1987 | Linker et al. | |
| 4,874,075 A | | 10/1989 | Linker et al. | |
| 5,484,374 A | * | 1/1996 | Bachner et al. | 493/87 |
| 5,752,367 A | * | 5/1998 | VerMehren | 53/473 |
| 6,012,267 A | | 1/2000 | Katsumata | |
| 6,066,081 A | * | 5/2000 | Bachner | 493/102 |
| 6,105,637 A | * | 8/2000 | VerMehren | 141/248 |
| 6,374,873 B1 | * | 4/2002 | Price et al. | 141/238 |
| 2002/0073648 A1 | | 6/2002 | Seveik et al. | |

* cited by examiner

*Primary Examiner*—John Sipos
(74) *Attorney, Agent, or Firm*—Welsh & Katz, Ltd.

(57) ABSTRACT

A closure feed system for use on an associated dual train form, fill, and seal packaging machine for feeding, diverting and singulating closures from a common closure storage region to a closure applicator includes an upper chute for conveying the closures from the storage region to a diverter/singulator, two lower chutes for conveying separated closures from the diverter/singulator to respective applicators, and a diverter/singulator for diverting and separating the closures. The upper chute defines an upper conveyance path, while the two lower chutes define two lower conveyance paths to their respective applicators. The diverter/singulator includes a reciprocating plate with two closure-holding grooves. As the plate slides between the upper and lower chutes, the grooves alternately align with the upper chute, or with the first or second lower chutes. A form, fill, and seal packaging machine including the closure feed system is also disclosed.

7 Claims, 4 Drawing Sheets

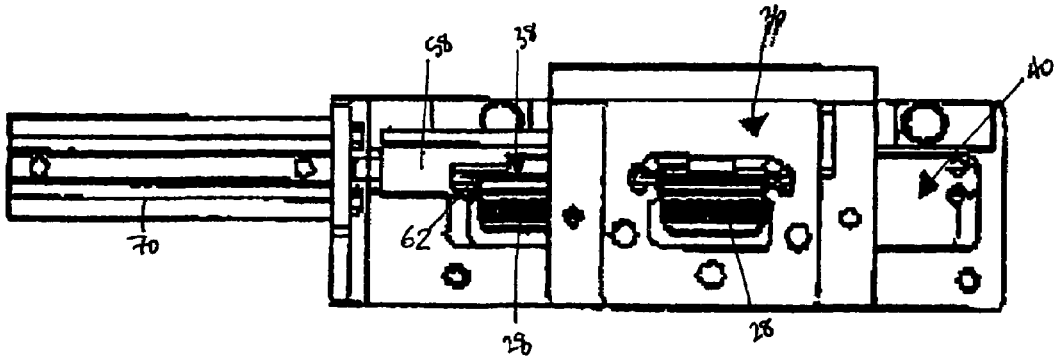
FIG. 4
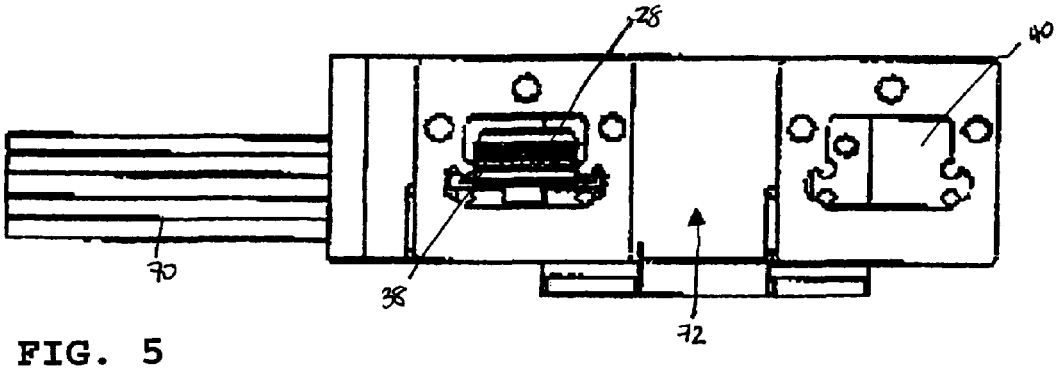
FIG. 5
FIG. 6
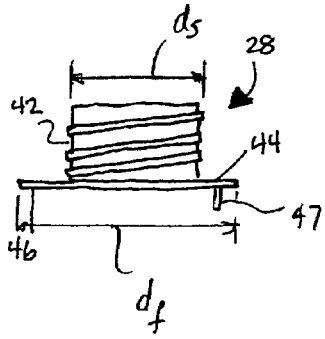

CLOSURE FEED SYSTEM WITH A SPOUT DIVERTER/SINGULATOR

BACKGROUND OF THE INVENTION

The present invention is directed to a diverter/singulator for closures in a closure feed system. More particularly, the present invention pertains to a diverter/singulator for a closure feed system for use in a form, fill, and seal packaging machine, in which closures are mounted to packages.

Many containers such as cartons are formed with integral spouts. For example, many known gable-top cartons feature resealable spouts mounted to one of the gable panels to facilitate dispensing contents from the carton and resealing the carton after use.

Packaging machines must mount spouts to the cartons at some point during their forming, filling, and sealing processes. To this end, packaging machines often include applicator stations, at which a spout is dispensed from a feed system, directed or diverted to an applicator and moved into contact with a carton. The applicator typically includes a sealing device, such as an ultrasonic sealing or welding head, which moves into contact with the carton while an accompanying closure rests on an anvil that also is moved into contact with the carton. Energy transmitted from the sealing device into the carton material above the spout seals the spout to the carton.

Because many modern packaging machines operate at high speeds (some at speeds up to about 14,000 packages per hour), one concern is that the spouts or closures must be dispensed at a rate commensurate with the overall speed of the packaging machine, while precisely and accurately dispensing closures for proper positioning within the applicator. Known dispensing arrangements may be subject to frequent clogs or bottlenecks in their spout feed lines, slowing the machines or requiring that they be shut down entirely in order to free obstructions. In addition, such high-speed machines often include parallel trains or lines of form, fill and seal stations. That is, the machines include two forming stations, two filling stations and two sealing stations that are side-by-side within the machine enclosure and operate in parallel. This is referred to as a dual-train form, fill and seal packaging machine.

Prior art closure feed systems generally rely on gravity, allowing spouts to fall through a single chute on to a reciprocating anvil in the applicator station. Shingling, in which the thin flanges surrounding a spout overlap one another and cause skewing, frequently cause jamming within such closure feed system, by allowing more than one closure to drop into position on the anvil. In addition, such systems require a diverter to direct or divert closures from a common supply to the individual reciprocating anvils.

United States patent application publication No. U.S. 2002/0073648 A1 (the '648 publication), now U.S. Pat. No. 6,807,792 assigned to the assignee of the present invention, attempts to address the jamming problems caused by closure shingling with closure feed systems that includes a singulator with upper and lower reciprocating members, or plungers. The plungers reciprocate in an opposing manner to one another, so that when the upper plunger is retracted, the lower plunger is extended, and when the upper plunger is extended, the lower plunger is retracted. The plungers prevent closure shingling by providing physical barriers between closures in the feed system queue. Though this system prevents the blockages caused by closure shingling, it nevertheless requires a separate system for each of the form, fill and seal trains. Moreover, additional space is required to house the reciprocating plungers, the other components for each of the singulators.

Accordingly, there exists a need for a simple closure feed system that prevents closure jamming and bottlenecks. Desirably, such a closure feed system dispenses a single closure at a time for receipt by a closure applicator. More desirably, such a system requires little space and a minimum of mechanical parts. Most desirably, such a system singulates the closures or spouts by alternately sliding spouts from a common chute into two separate chutes to accomplish diverting the closures (to the two trains of the dual train form, fill and seal machine) in a unit common with the singulating function.

BRIEF SUMMARY OF THE INVENTION

A closure feed system for use on an associated dual train form, fill, and seal packaging machine for feeding, diverting and singulating closures from a common closure storage region to respective (train-dedicated) closure applicators includes an upper chute, first and second lower chutes, and a diverter/singulator. The upper chute conveys closures from the storage region to the diverter/singulator, and defines an upper conveyance path. The first and second lower chutes convey separated closures from the diverter/singulator to the applicator, and define first and second lower conveyance paths, respectively.

The diverter/singulator includes a reciprocating plate that has first and second main closure-holding grooves. The plate is configured for sliding between the upper and lower chutes, so that when the first groove is aligned with (e.g., located under) the upper chute the second groove is aligned with (e.g., over) the second lower chute, and when the second groove is aligned with (e.g., located under) the upper chute the first groove is aligned with (e.g., over) the first lower chute.

In a preferred embodiment, a first minor groove lies within the first main groove, and a second minor groove lies within the second main groove. The minor grooves accommodate an aligning pin, such as that that can be used on an orientationally sensitive closure. A cylinder, most preferably a pneumatic cylinder, is used to reciprocate the plate.

The closure feed system can include a frame for carrying the upper chute, the diverter/singulator, and the first and second lower chutes together. Preferably, the plate slides within a guide on the frame. The frame can also include a lidded aperture positioned under the upper chute, to allow the discharge of a queue of closures from the upper chute.

A dual train form, fill, and seal packaging machine for forming, filling, and sealing packages in two parallel trains that feature a flanged, carton-mounted closure is also disclosed. The machine includes a carton magazine, a carton erection station, a closure applicator station, two filling stations, and two top sealing stations. The closure applicator station includes a closure storage region and two train-dedicated closure applicators, as well as an upper chute, first and second lower chutes, and a diverter/singulator. The upper chute conveys closures from the storage region to a diverter/singulator, and defines an upper conveyance path. The first and second lower chutes convey separated closures from the diverter/singulator to the respective applicators, and define first and second lower conveyance paths, respectively.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
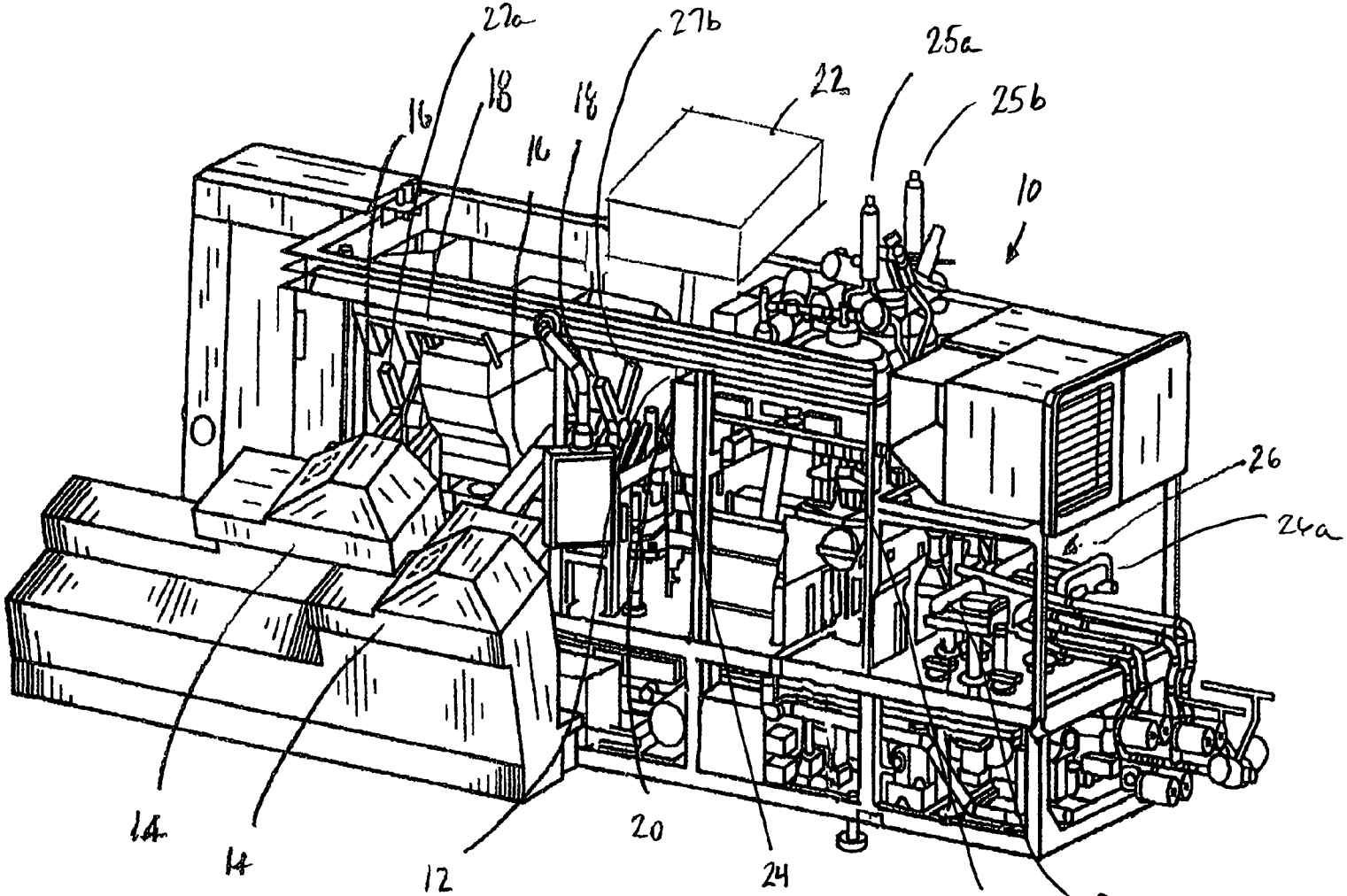
FIG. 1 is a perspective view of an exemplary form, fill, and seal packaging machine having a closure feed system embodying the principles of the present invention.
Figure 2:
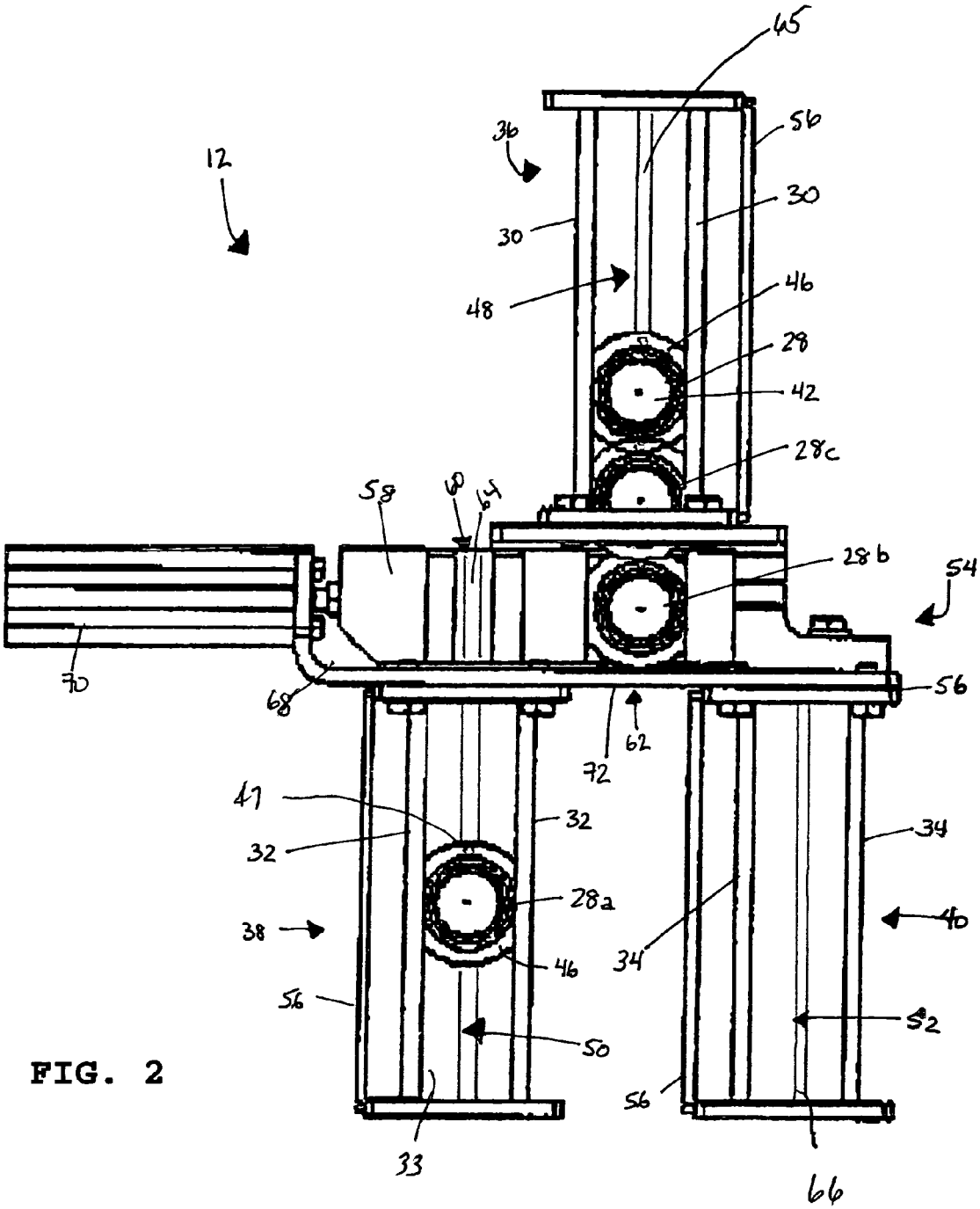
FIG. 2 is a front view of a closure feed system having a closure diverter/singulator embodying the principles of the present invention, the system shown with closures positioned within the upper chute and the first lower chute.
Figure 3:
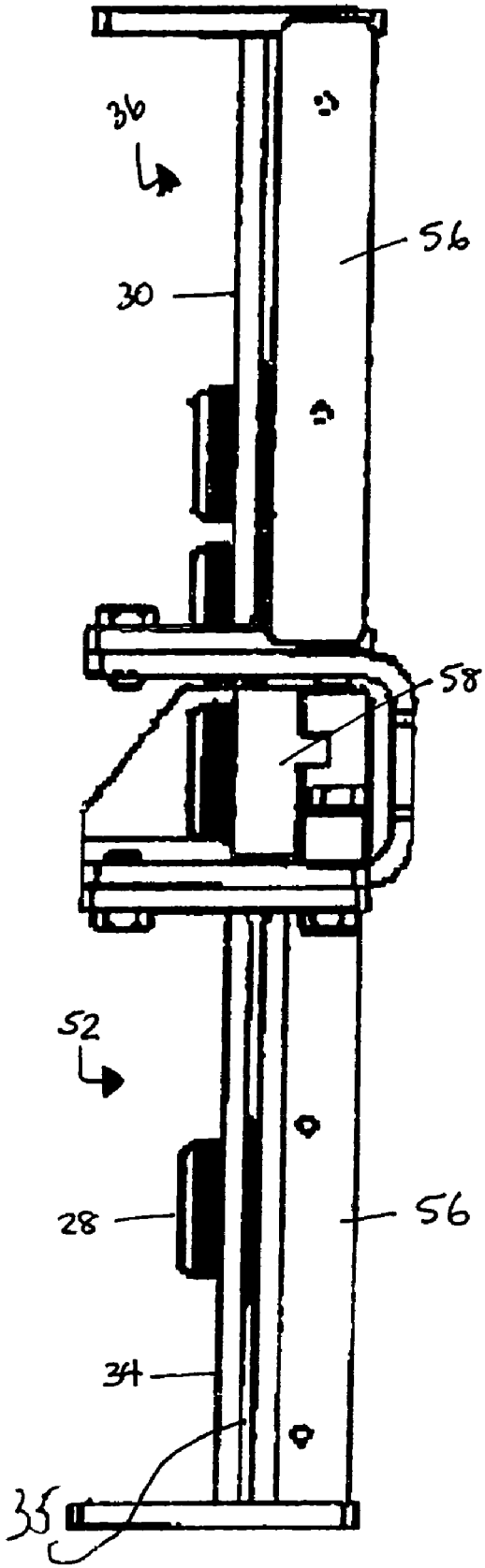
FIG. 3 is a side view of the closure feed system of FIG. 2, as seen from the right-hand side of FIG. 2.
Figure 1:
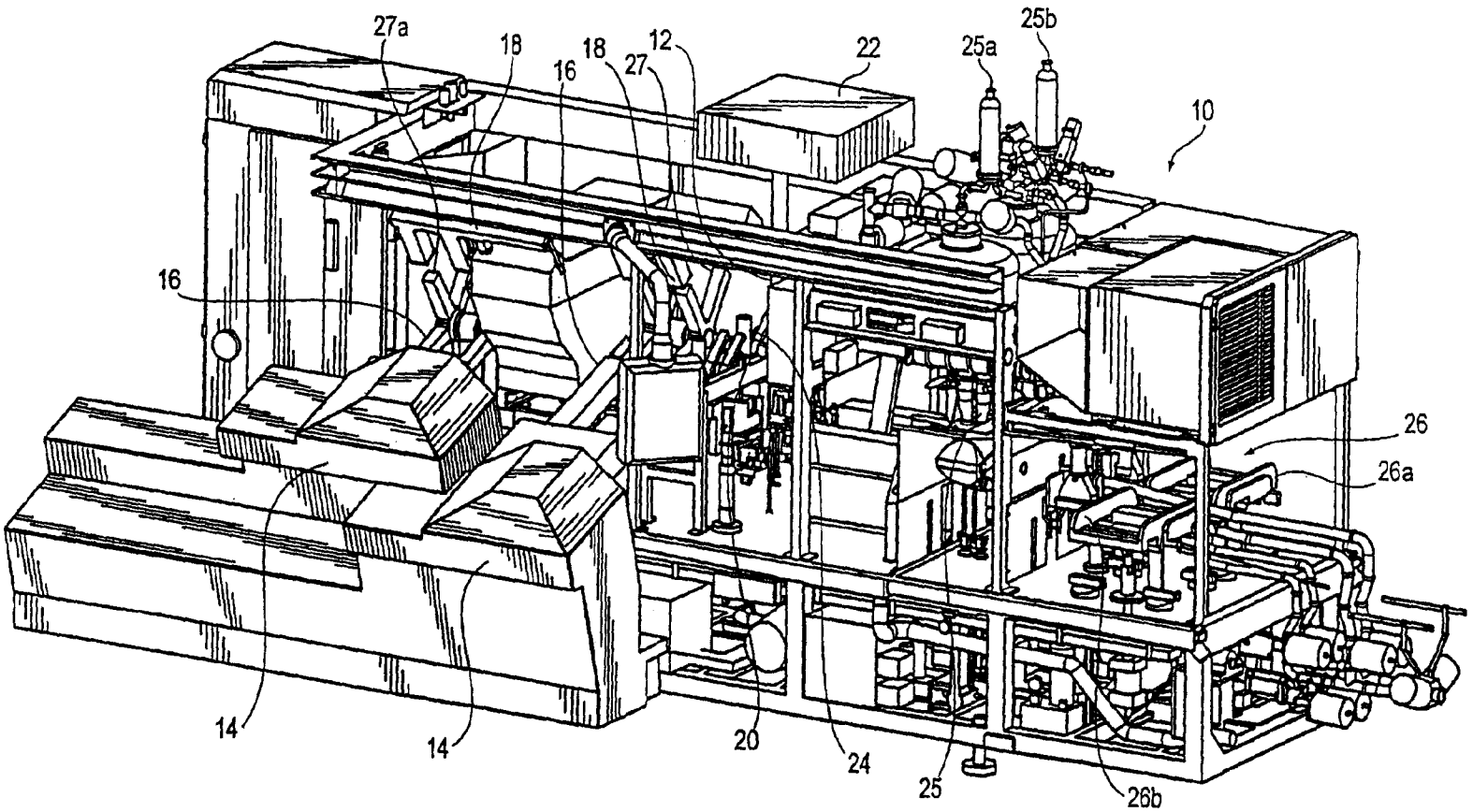
Figure 2:
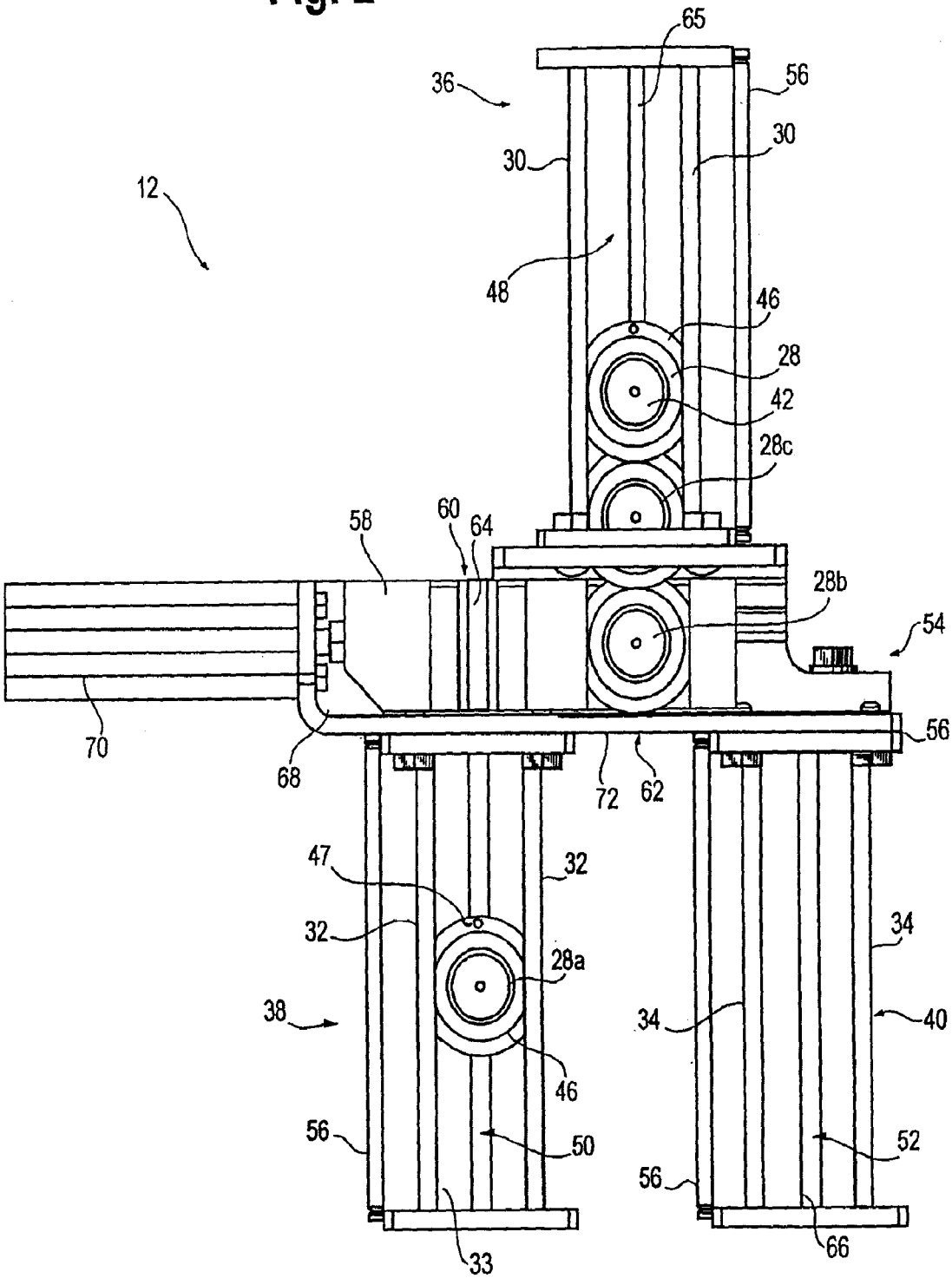
Figure 3:
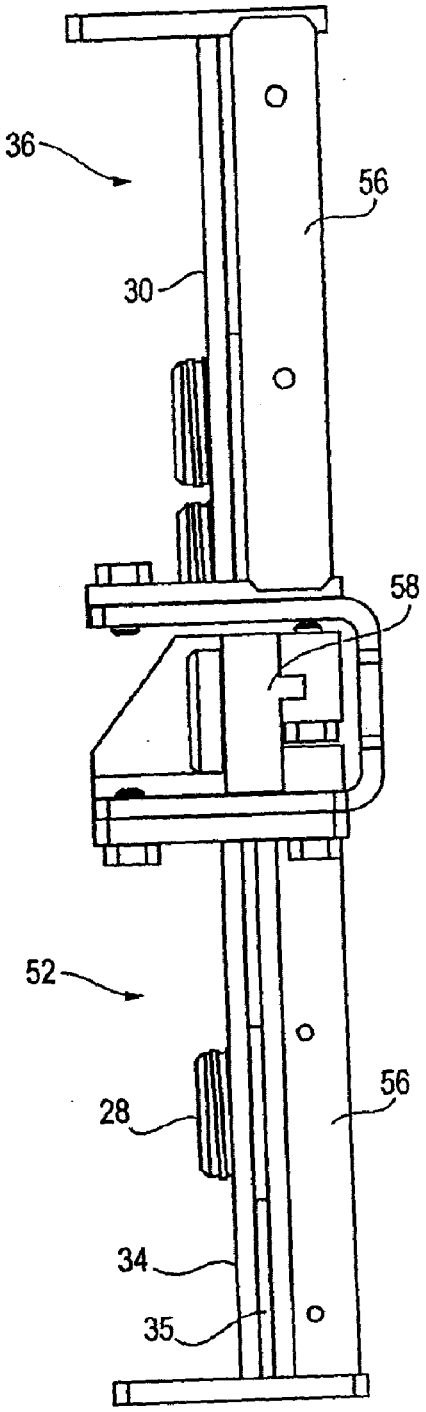
Figure 4:
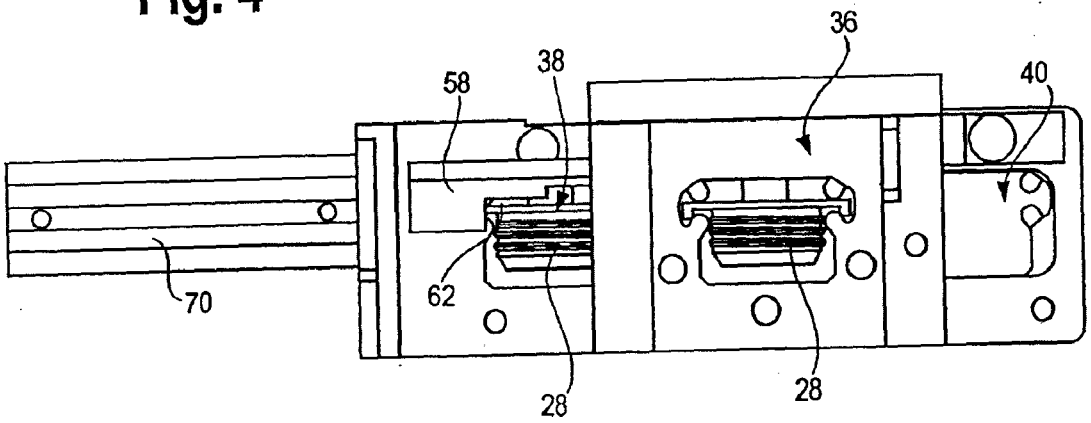
FIG. 4 is a top view of the closure feed system of FIG. 2.
Figure 5:
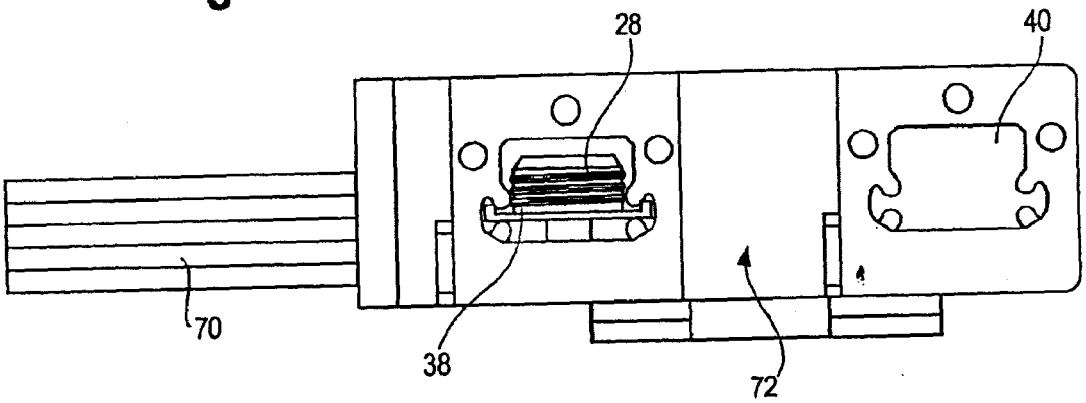
FIG. 5 is a bottom view of the closure feed system of FIG. 2.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular to FIG. 1, there is shown a known form, fill, and seal packaging machine 10. The packaging machine 10 includes a closure feed system, indicated generally at 12, embodying the principles of the present invention. The form, fill, and seal packaging machine 10 includes a carton magazine 14 for storing flat, folded cartons prior to erection. The machine 10 further includes a carton erection station 16, a bottom flap sealing station 18, and a closure applicator station 20. The closure applicator station 20 preferably includes a closure storage region 22, a closure applicator 24, and the closure feed system 12. Subsequent to closure application, cartons may be sterilized, filled at a filling station 25, and sealed at a top sealing station 26 to form a well-known gable-top shape. Finally, cartons are off-loaded from the machine 10. The construction and design of an exemplary machine is disclosed in Katsumata, U.S. Pat. No. 6,012,267, which patent is assigned to the assignee of the present invention, and which patent is incorporated herein by reference for purposes of that patent's disclosure of such a machine. The illustrated machine is a dual-train machine. That is, the machine includes two forming stations (as illustrated by the two mandrel wheels 27*a*, 27*b*), two filling stations 25*a,b* and two sealing stations 26*a,b* that are side-by-side within the machine 10 enclosure and operate in parallel.

Figure 6:
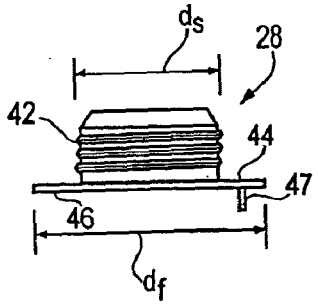
FIG. 6 illustrates an exemplary closure suitable for use with the present closure feed system.

As shown in FIG. 1, closures 28 (the closures are not seen in FIG. 1) are fed from a common closure storage unit or region 22, such as a bin, into the common closure feed system 12. As seen in FIGS. 2–5, the closure feed system 12, which functions to feed closures 28 to both of the operating form, fill and seal trains, includes a plurality of rails 30, 32, and 34 that define an upper chute 36 and first and second lower chutes 38, 40 respectively for the closures 28. A typical closure 28, as illustrated in FIG. 6, includes a spout 42 that extends upwardly from one side 44 of a flange 46. The flange 46 has a diameter $d_f$ that is substantially larger than a diameter $d_s$ of the spout 42.

Returning to FIGS. 2–5, the upper chute 36 defines an upper conveyance path 48, and the first and second lower chutes 38, 40 define first and second lower conveyance paths 50, 52 respectively. Closures 28 maintain a desired orientation while moving through the upper and lower conveyance paths 48, 50, 52 of the upper and lower chutes 36, 38, 40 because sides of their flanges 46 are bound by narrow openings or gaps (see, e.g., gap 35 in FIG. 3) between adjacent pairs of rails 30, 32, 34 of the upper and lower chutes. The spouts 42 of the closures 28 extend through larger openings or gaps between opposing pairs of the rails 30, 32, 34 (see, e.g., opening 33 in FIG. 2).

The upper chute 36 guides the closures 28 from the storage unit or region 22 to a diverter/singulator 54. After being separated by the diverter/singulator 54, the closures 28 are directed through the first and second lower chutes 38, 40 to their respective applicators (one for each train, as indicated generally at 24). A frame 56 preferably holds the upper chute 36, the first and second lower chutes 38, 40, and the diverter/singulator 54 mounted together. The diverter/singulator 54 includes a reciprocating plate 58, which has first and second main closure-holding grooves 60, 62. It will be appreciated by those skilled in the art that the present diverter/singulator permits using a single component to diverter closures 28 to each of the trains (the a train and the b train) and, at the same time, singulates the closures 28 to separate the closures 28 from one another.

The plate 58 is configured for sliding between the lower chutes 38, 40, so that when the first main groove 60 is under the upper chute 36 (for receiving a closure), the second main groove 62 is aligned over the second lower chute 40, and when the second main groove 62 is under the upper chute 36 (for receiving a closure), the first main groove 60 is aligned over the first lower chute 38. A first minor groove 64 preferably lies within the first main groove 60, and a second minor groove 66 may lie within the second main groove 62. The main grooves 60, 62 are dimensioned to accommodate the closure spout 46. For those systems that may be used to transport an orientationally sensitive closure having, for example, an aligning pin 47 extending from the rear of the flange 46, the minor grooves 64, 65, 66 accommodate the pin 47 and maintain the orientation of the closure 28 as it traverses through the chutes 36, 38, 40.

As described above, one of the problems encountered in known closure feed systems is that closure flanges tend to shingle as the closures travel through chutes, held between the rails. To this end, the present closure feed system 12 overcomes these problems by using a diverter/singulator 54 to physically separate closures 28 along two lower conveyance paths 50, 52. In that the physical separation of the closures 28 occurs substantially in the plane parallel to the plane of the flanges 46, damage to the flanges 46 (due to "forced" separation) is prevented.

Operation of the closure feed system 12 is simple and straightforward. Closures 28 enter the upper conveyance path 48 through the upper chute 36, their flanges 46 confined between adjacent pairs of rails 30. The closure spouts 42 extend through the larger opening or gap between opposing pairs of the rails 30. After a closure 28 has traveled through the upper chute 36, it reaches the diverter/singulator 54.

The reciprocating plate 58 of the diverter/singulator 54 laterally slides between the upper chute 36 and the lower chutes 38, 40. The sliding of the plate 58 can be limited by a guide 68 located on the frame 56. The illustrated plate 58 is driven by a cylinder 70, such as the exemplary pneumatic cylinder. For this description, it will be assumed that the first main groove 60 of the plate 58 is initially located under the upper chute 36, but the closure feed system 12 may commence operation with the plate 58 in any position along the guide 68.

A first closure 28*a* exits the upper chute 36 into the first main groove 60 of the plate 58. Sides of the first main groove 60 confine the flanges 46 of the first closure 28*a*, much like the adjacent pairs of rails 30 of the upper chute 36. The plate 58 then laterally slides, moving the first main groove 60 into a position over the first lower chute 38. When the first main groove 60 is in place over the first lower chute 38, the first closure 28*a* falls out of the first main groove and into the first lower conveyance path 50. The main grooves 60, 62 are spaced from one another so that when the first main groove 60 is aligned over the first lower chute 38, the second main groove 62 is located under the upper chute 36. Concurrently, a second closure 28*b* falls out of the upper chute 36 and into the second main groove 62 of the plate 58.

Again, in those instances in which a closure with an aligning (orienting) pin 47 is used, the pin 47 is aligned with minor groove 65 in the upper chute 36 and, as the closure 28 falls though the upper chute 36 and is diverted by the plate 58, the pin 47 remains aligned and "falls" into minor groove 64, in first lower chute 38. The pin 47 remains in the 12 o'clock position (by virtue of the eccentric location of the pin 47 and gravity acting on the closure 28), thus maintaining the orientation of the closure 28.

Next, the plate 58 laterally slides again, this time moving the second main groove 62 into a position over the second lower chute 40. When the second main groove 62 is in place over the second lower chute 40, the second closure 28 falls out of the second main groove and into the second lower conveyance path 52. As the second closure 28*b* exits the second main groove 62, a third closure 28*c* drops into the first main groove 60 from the upper chute 36. The plate 58 reciprocates, and the process begins anew. And, if an orientationally sensitive closure is used, the pin traverse into minor groove 66 in second lower chute 40.

In addition, the frame 56 can include a lidded aperture (not shown), located directly under the upper chute 36. This aperture permits closure feed system operators to empty the upper chute 36 of its queue of closures 28 to perform maintenance on the system, when the reciprocating plate 58 is slid fully to one side.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A dual train form, fill, and seal packaging machine for forming, filling, and sealing packages in two parallel form, fill and seal paths, the packages having a closure mounted thereto, comprising:

a carton magazine;

a carton erection station;

a closure applicator station including a closure storage region and a first and second closure applicators, each of the applicators associated with a respective one of the form, fill and seal trains, the applicator station further including a closure feed system with an upper chute for conveying the closures from the storage region to a diverter/singulator, the upper chute defining an upper conveyance path, the closure feed system including first and second lower chutes defining first and second lower conveyance paths for conveying separated closures from the diverter/singulator to the respective applicators, wherein the diverter/singulator includes a laterally reciprocating plate having first and second main closure-holding grooves, the plate configured for sliding between the upper and lower chutes, so that when the first main groove is aligned with the upper chute the second main groove is aligned with the second lower chute, and when the second main groove is aligned with the upper chute, the first main groove is aligned with the first lower chute;

first and second filing stations; and first and second top sealing stations.

2. The form, fill, and seal packaging machine in accordance with claim 1, wherein a first minor groove lies within the first main groove, and a second minor groove lies within the second main groove.

3. The form, fill, and seal packaging machine in accordance with claim 1, including a drive for reciprocating the reciprocating plate.

4. The form, fill, and seal packaging machine in accordance with claim 3, wherein the drive is a pneumatic cylinder.

5. The form, fill, and seal packaging machine in accordance with claim 1, including a frame for carrying the upper chute, the diverter/singulator, and the first and second lower chutes.

6. The form, fill, and seal packaging machine in accordance with claim 5, wherein the reciprocating plate slides within a guide on the frame.

7. The form, fill, and seal packaging machine in accordance with claim 5, wherein the frame includes a lidded aperture positioned under the upper chute.

* * * * *

UNITED STATES PATENT AND TRADEMARK OFFICE

CERTIFICATE OF CORRECTION

PATENT NO. : 7,017,322 B1
APPLICATION NO. : 10/968084
DATED : March 28, 2006
INVENTOR(S) : Annehed et al.

It is certified that error appears in the above-identified patent and that said Letters Patent is hereby corrected as shown below:

Four (4) sheets of replacement drawings entered. On next page

Signed and Sealed this

Tenth Day of October, 2006

JON W. DUDAS
*Director of the United States Patent and Trademark Office*